United States Patent [19]

Lisowyj et al.

[11] Patent Number: 4,686,031

[45] Date of Patent: Aug. 11, 1987

[54] BENEFICIATION OF GALLIUM IN FLY ASH

[75] Inventors: Bohdan Lisowyj; David C. Hitchcock, both of Omaha, Nebr.

[73] Assignee: InterNorth, Inc., Omaha, Nebr.

[21] Appl. No.: 813,968

[22] Filed: Dec. 27, 1985

[51] Int. Cl.[4] ..... B07B 4/08

[52] U.S. Cl. ..... 209/2; 209/10

[58] Field of Search ..... 209/2, 3, 21, 138, 10; 106/DIG. 1

[56] References Cited

U.S. PATENT DOCUMENTS

| | | | |
|---|---|---|---|
| 3,533,819 | 10/1970 | Pennachetti | 106/288 B |
| 3,712,469 | 1/1973 | Dwyer et al. | 209/111.7 |
| 3,957,459 | 5/1976 | Mitchell et al. | 209/138 |
| 4,121,945 | 10/1978 | Hurst et al. | 106/288 B |
| 4,147,620 | 4/1979 | Artiano | 209/590 |
| 4,212,398 | 7/1980 | Parker et al. | 209/590 |
| 4,475,993 | 10/1984 | Blander et al. | 204/64 |

FOREIGN PATENT DOCUMENTS

| | | |
|---|---|---|
| 612493 | 1/1961 | Canada . |
| 2407948 | 8/1974 | Fed. Rep. of Germany . |

OTHER PUBLICATIONS

*Report of Investigation* 6940, as listed in applicant's disclosure statement.

*Journal of the Less Common Metals*, as listed in applicant's disclosure statement.

*Primary Examiner*—Andres Kashnikow

*Assistant Examiner*—Mary Beth O. Jones

*Attorney, Agent, or Firm*—Zarley, McKee, Thomte, Voorhees & Sease

[57] ABSTRACT

A method for the beneficiation of gallium from fly ash involves subjecting the ash to particle size classification while avoiding substantial rupturing of cenospheres and plerospheres in the ash and isolating thereby up to 30 percent of the finest ash particles which are lower in iron content.

2 Claims, No Drawings

BENEFICIATION OF GALLIUM IN FLY ASH

BACKGROUND OF THE INVENTION

The present invention relates to a method for the removal of gallium from fly ash. In many industrial processes, fly ash is produced in chimneys or stacks where electrostatic precipitators or other recovery equipment are used to remove particulates. In general, the fly ash is composed of fine grained particles having a silicate base with small amounts of some trace metals concentrated on the surfaces of the particles. Some of these trace metals are valuable, including copper, nickel, gallium, and germanium. Others, such as arsenic, lead and mercury, are toxic.

Numerous attempts have been made in the past to recover certain of the trace metals present in fly ash. *Report of Investigations* 6940 of the United States Department of the Interior, Bureau of Mines, entitled "Extraction of Germanium and Gallium from Coal Fly Ash and Phosphorous Furnace Flue Dust" by R. F. Waters and H. Kenworthy (1967) describes the efforts of the Bureau of Mines to recover germanium and gallium. Sublimation of these trace metals was the method described in the report. Furthermore, U.S. Pat. No. 4,475,993, issued Oct. 9, 1984, describe a process for recovering silver, gallium and other trace metals from a fine grained industrial fly ash. The process involves contacting the fly ash with aluminum trichloride in an alkali halide melt to react the trace metals with the aluminum trichloride to form compositions soluble in the melt and a residue which contains the silicate and aluminum oxide. Then, the desired trace metals are separated from the met by electrolysis or other separation techniques.

The methods described above suffer from low starting concentrations of gallium which takes them uneconomic. The method of the present invention entails a preliminary beneficiation stage in which the ash has its gallium concentration increased. Furthermore, the classification also reduces the iron content in the ash. Iron is a known contaminant in sublimation processes due to its facility for oxidizing the gallium suboxide to gallium sesquioxide. The gallium sesquioxide is a non-volatile variety of gallium which cannot be sublimed. The process of this invention is an ideal first step in gallium extraction methods.

SUMMARY OF THE INVENTION

The present invention relates to a method for the beneficiation of gallium in fly ash. The method comprises the steps of subjecting the ash to particle size classification while avoiding substantial rupturing of cenospheres and plerospheres if these are present in the ash. The classification step preferably isolates up to 30 percent of the finest particles in the fly ash. Dense particles rich in iron have been found to be present in the coarse fractions. The fines can then be subjected to a variety of treatments to extract the beneficiated valuable trace elements. In the case of gallium, extraction techniques could include:

(i) An alkali halide melt (U.S. Pat. No. 4,475,993), (ii) Acid dissolution and extraction, (Ref.: Baldwin, W. G.; Bock, E.; Chow, A.; Gesser, H. D.; McBride, D. W.; Vardya, O., "The Acid Extraction of Gallium From Ores", *Hydrometallurgy*, 1580, 5, pp. 213–225) or as in this invention, or (iii) A sublimation treatment in which the fly ash particles are heat treated between 900° C. to 1100° C. in the presence of a reducing gas to cause the gallium to sublime and be carried off in the gas. This gas is then collected on a "cold finger" introduced into the furnace.

DETAILED DESCRIPTION OF THE INVENTION

It is known that gallium and other trace metals are present in fly ash. These metals are present in coal also and it is theorized that during the burning of coal, gallium is volatilized. As the fly ash cools, gallium and other trace metals condense on the ash. This theory is supported by the fact that there is very little gallium in the plerospheres which are formed in the ash. These are little hollow spheres of silica with several hundred smaller spheres crowded within.

As stated above, particle size classification is a critical part of the present invention. The reason that this method assists in the concentration and recovery of gallium is that there appears to be more gallium per particle weight on the smaller particles than on the larger particles. It is theorized that this is the result of the coating of the fly ash particles by gallium from the cooling combustion gases. If the theory is correct, then each particle, regardless of size, is coated to the same extent with gallium. Therefore, the smaller particles must have a higher portion of their weight as gallium and if these smaller particles can be successfully separated from the larger particles, a fraction with a higher concentration of gallium can be obtained.

There are several methods of particle size classification which can be used in the present invention. The first method utilizes a sieve through which the particles are forced by air pressure or otherwise. The larger particles are prevented from passing through the sieve because of the size of the openings therein. This method is not particularly desirable because it is very abrasive and increases the chances of breakage of the cenospheres and plerospheres which, if present, contain very little gallium and which, if broken up, would add non-gallium weight to the fines portion of the classification division.

Water classification can also be used. In this method, water flows up through a column of fly ash and carries the fine particles with it because they are lighter. A fast flow rate will carry heavier particles because these will not have time to settle out. Thus, it is important that the rate through the column be adjusted to maximize the separation of gallium-containing fines particles from the rest of the fly ash.

The preferred method for particle size classification in the present invention involves allowing the ash particles to fall onto a rotating horizontal disk. The rotation tends to push the particles outwardly. There are gas jets blowing across the path of the falling particles. These gas jets tend to move the finest particles to the outside because they are lighter in weight and more easily influenced by the gas stream.

We have found in one case that if one takes the ten percent fraction which contains the finest particles, the gallium concentration can be increased by a factor of as much as 3.3 (if the last method is used and 2.4 by the other methods). The percentage of the fines fraction which is taken off can be varied from up to 30% and very good results are still achieved. It is theorized that the third method is best because it is less abrasive and more efficient in separation due to better particle dispersion. Once the finest fraction has been removed it is possible to beneficiate the remaining coarse fraction. The coarse fraction is agitated in contact with a clean sand, e.g. Ottawa sand. This agitation or attrition scrub removes the other layers of the coarse particles, which are rich in gallium. After this treatment, the mixture is reclassified and the finest portion is found to be rich in gallium. This process can only be performed on ashes with low cenosphere and plerosphere contents.

A heat treatment may be employed next. The finest particles may be heated to a temperature of 900° to 1100° C. in the prescence of a reducing gas. Suitable reducing gases are hydrogen, methane and carbon monoxide. The gas is passed over the particles and carries of gallium which sublimes at these high temperatures. The gallium will condense onto a "cold finger" introduced into the furnace. The sublimate obtained by this method has a concentration approximately 40 times higher than that of the original ash.

EXAMPLES

Example 1

| | |
|---|---|
| Starting Ash 1: | 100 ppm Gallium |
| (i)(a) 10% finest fraction separated with non-abrasive technique: | 330 ppm Gallium |
| (b) 10% finest fraction separated with non-abrasive technique then collected as sublimate: | 4,000 ppm Gallium |
| (ii) 10% finest fraction separated with abrasive technique: | 240 ppm Gallium |
| (iii) 10% finest fraction separated with water classifier: | 220 ppm Gallium |

Example 2

| | |
|---|---|
| Starting Ash 2: | 142 ppm Gallium (6.0% Iron) |

-continued

| | |
|---|---|
| Non-abrasive technique | |
| 56% finest fraction: | 166 ppm Gallium |
| 30% finest fraction: | 192 ppm Gallium |
| 15% finest fraction: | 269 ppm Gallium (3.0% Iron) |
| 85% coarse fraction: | 118 ppm Gallium |
| 85% coarse fraction attrition scrubbed and classified to finest 15% fraction: | 203 ppm Gallium |

Example 3

The results of Example 3 show that a high percentage of gallium can be removed from fly ash beneficiated according to the non-abrasive method. This in part is attributable to the low iron content in this ash. The sublimation took place under the conditions set forth in Table 1.

TABLE 1

| Starting Material = 240 ppm Gallium | | | |
|---|---|---|---|
| TEMP. (°C.) | TIME (Hrs.) | PPM (Ga) | % GALLIUM Removed |
| 900 | 1 | 100 | 58.3 |
| | 3 | 69 | 71.2 |
| 1,000 | 1 | 74 | 69.2 |
| | 3 | 47 | 80.4 |
| 1,100 | ½ | 90 | 62.8 |
| | 1 | 63 | 73.7 |
| 1,200 | ½ | 120 | 50.0 |

We claim:

1. A method for the beneficiation of gallium and other valuable trace elements from fly ash, which comprises subjecting the ash to particle size classification while avoiding substanial rupturing of cenospheres and plerospheres in the ash and isolating thereby up to 30 percent of the finest ash particles.

2. The method of claim 1 wherein the subjection of the ash to said particle size classification also reduces the iron content of said ash.

* * * * *